US005168259A

United States Patent [19]

Takemura

[11] Patent Number: 5,168,259

[45] Date of Patent: Dec. 1, 1992

[54] SUPERCONDUCTING COIL

[75] Inventor: Yasuhiko Takemura, Atsugi, Japan

[73] Assignee: Semiconductor Energy Laboratory Co., Ltd., Kanagawa, Japan

[21] Appl. No.: 815,585

[22] Filed: Dec. 30, 1991

Related U.S. Application Data

[63] Continuation of Ser. No. 583,567, Sep. 17, 1990.

[30] Foreign Application Priority Data

Sep. 19, 1989 [JP] Japan ..... 1-242585

[51] Int. Cl.[5] ..... H01F 7/22; H01F 36/00

[52] U.S. Cl. ..... 335/216; 336/DIG. 1; 323/360; 505/705; 505/880; 505/870; 505/1

[58] Field of Search ..... 505/1, 701, 704, 705, 505/741, 919, 920, 921, 924, 880, 870; 336/DIG. 1; 335/216; 361/19; 323/360

[56] References Cited

U.S. PATENT DOCUMENTS

| | | | |
|---|---|---|---|
| 3,333,331 | 8/1967 | Swartz | 29/599 |
| 4,629,707 | 12/1985 | Wolfe . | |
| 4,794,894 | 1/1989 | Gill . | |
| 4,806,040 | 2/1989 | Gill et al. . | |
| 4,848,286 | 7/1989 | Bentz . | |
| 4,970,483 | 11/1990 | Wicker et al. | 335/216 |

FOREIGN PATENT DOCUMENTS

| | | | |
|---|---|---|---|
| 55-77109 | 6/1980 | Japan . | |
| 63-241891 | 10/1988 | Japan . | |
| 0262808 | 10/1988 | Japan | 505/705 |
| 4001208 | 1/1989 | Japan | 505/705 |
| 1-33872 | 2/1989 | Japan . | |
| 0068907 | 3/1989 | Japan | 336/DIG. |
| 0074705 | 3/1989 | Japan | 505/705 |
| 2-49367 | 2/1990 | Japan . | |

*Primary Examiner*—Leo P. Picard
*Assistant Examiner*—Bot L. Ledynh
*Attorney, Agent, or Firm*—Sixbey, Friedman, Leedom & Ferguson

[57] ABSTRACT

A superconducting coil is disclosed. A plurality of coils made of oxide superconducting materials are formed on the respective surfaces of substrates, and the adjacent coils mounted on the substrates are connected by conductors to form one coil. Since the coil consists mainly of oxide superconductor, liquid nitrogen can be used to cool at a temperature less than Tc the coil which is energized in order to generate a magnetic field. Therefore it costs less to generate a magnetic field by the coil than by the conventional coils made of metallic superconductors. In addition, the coil is mechanically strong.

16 Claims, 6 Drawing Sheets

SUPERCONDUCTING COIL

This application is a continuation of Ser. No. 07/583,567 filed Sep. 17, 1990, now abandoned.

BACKGROUND OF THE INVENTION

1. Field of the Invention

The present invention relates to a coil made of a superconducting oxide material.

2. Description of the Prior Art

Superconductors have a property that the electric resistance is zero at a temperature less than the transition temperature. Utilizing this property, superconducting electromagnets for generating magnetic fields have already been made fit for practical use by the use of metallic superconductors. Since metallic superconductors have sufficient ductility and malleability, high carrier concentration, and large coherent length, superconducting electromagnets which generate great magnetic fields can be formed by the use of such metallic superconductors. However, in the metallic superconductors a critical temperature at which superconductivity starts (referred to as Tc) is extremely low. Therefore, it was necessary to use liquid helium to maintain the metallic superconductors at a temperature less than the critical temperature in order to produce superconductivity. But the liquid helium has drawbacks that it is so expensive and it is unevenly distributed as a natural resource. On the other hand, recent years, superconducting oxide has been discovered which exhibits superconductivity at a liquid nitrogen temperature or higher. Superconducting electromagnets using such a new superconducting oxide can generate a high magnetic field by making use of liquid nitrogen.

However, there are some problems to be solved when superconducting electromagnets are manufactured by the use of the new superconducting oxide. One is how to form the superconducting oxide which is lack of ductility and malleability into a coil. The other is how to make the coil made of the superconducting oxide which has less grain boundaries in order to improve critical current density of the coil. Concerning the first problem, the superconducting oxide is stuffed in a silver tube used as a sheath material and is wiredrawn, whereby the development of a technique for forming superconducting wires is in progress. On the other hand, concerning the second problem, materials having very few grain boundaries and extremely large critical current density are being developed by means of melting method. However, these two ways to solve the problems are contradictory to each other, so that fundamentally any solutions have not been obtained yet. Namely, superconducting oxide wires formed by means of sheath method using silver tubes have low critical current density in general, and the critical current density falls largely by applying magnetic fields to the wires. On the other hand, the superconducting oxide produced by means of the melting method exhibits sufficiently large critical current density in a magnetic field, but how to form the superconducting oxide into a coil by the use of the melting method has not been entirely researched yet.

Further, since superconducting oxide has low carrier density and extremely short coherent length, grains in the superconducting oxide tend to be electrically connected to each other weakly. For this reason, in superconducting oxide critical current density is extremely low. Compared with the superconducting oxide produced by means of the silver sheath method, the superconducting oxide produced by means of the melting method has large coherent length and high critical current density. Even though electromagnets, namely, closed coils are formed using such superconducting oxide in either method, the coils, except for small coils such as coils having one loop, lose some energy to generate some heat at the connection of both ends of the coils. Therefore, the electromagnets consume large electric power and can not generate large magnetic fields. For example, in the case of connecting both ends of the coils by the use of conductors, the conductors lose some energy due to electric resistance of the conductors themselves and thereby some heat is generated. Therefore, the consumption of electric power is large in such coils and the coils can not generate large magnetic fields.

Here a case of producing a multiturn air-core solenoid coil is taken as an example. The radius of the coil is 10 cm, the inside diameter of the coil is 5 cm, and the length of the coil is 10 cm. A lead wire used for the coil has a cross section of a square having a size of 0.2 mm$\times$0.2 mm. When rolling simply the lead wire $1.25\times10^6$ times per meter and applying a current of 1A to the lead wire, the density of the current flowing in the lead wire is 2500A/cm$^2$, and a magnetic field which this solenoid coil generates is about 1.6 tesla in the center of the coil.

However, the length of the lead wire reaches $6\times10^6$ cm and the resistance of the coil is about $1.5\times10^4\Omega$ in the case where the resistivity of the lead wire is $1\times10^{-6}\Omega$.cm. The demand of the coil reaches 15 kW.

Such a solenoid coil becomes useless as an electromagnet unless the coil is associated with a cooling apparatus to remove a large amount of heat generated from the coil. However, cooling the coil by the cooling apparatus costs a lot.

SUMMARY OF THE INVENTION

It is an object of the present invention to provide coils which are made of superconducting oxide materials and have high mechanical strength.

In order to attain this object, a superconducting oxide coil is formed on a substrate. In a condition that the substrate carries this coil, an electric power is applied to this coil to generate a magnetic field. Since the substrate carries this coil, extremely high mechanical strength is obtained in the superconducting oxide coil which is naturally fragile. This coil can be used as an electromagnet. Alternatively a plurality of such coils connected to each other can be used as an electromagnet.

PREFERRED EMBODIMENT OF THE INVENTION

Figure 1:
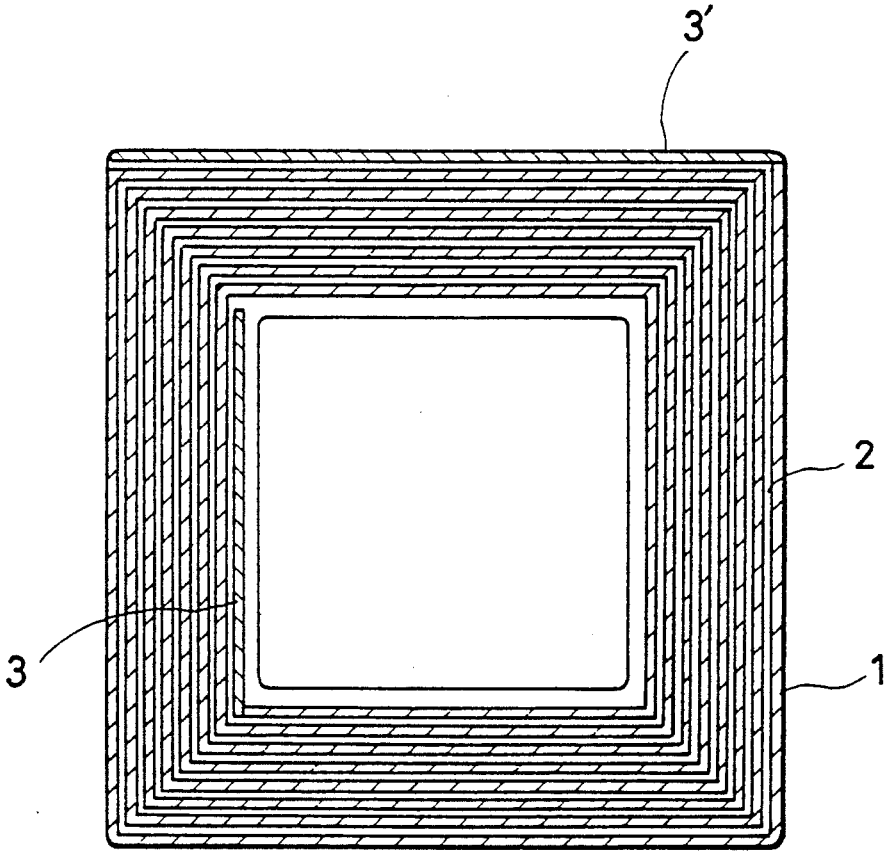
FIG. 1 is an outline showing a superconducting coil formed on a substrate.

A superconducting thin film is formed vortically on a substrate, for example an insulating substrate. (The superconducting thin film formed vortically on a substrate is referred to as a superconducting coil unit hereinafter.) A good conductor is provided between the superconducting coil units and thereby a plurality of such units is electrically connected to each other to constitute a coil. In order to connect the superconducting units with each other, metal may be used which has sufficiently low resistance. In this case, conducting parts which do not exhibit superconductivity exist in the circuit. Thus, even if a closed circuit is constituted in the preceding condition, a permanent current does not flow in the circuit. However, since the resistance of this circuit consists of only contact resistance between the conductor and the superconductor and resistance of the conductor, the circuit exhibits very low resistance value in total, compared with a circuit composed of only conductors which do not exhibit superconductivity.

A problem that coils generate some heat is immediately solved by substituting superconductors for almost all of lead wires. It is ideal that only two end portions of a coil which serve as terminals for current introduction are made of conductor and superconductors are substituted for the remaining coil portions. But because of the difficulty of processing superconducting oxide, it is preferred to use conductors inside the coil, too. An example is given that a coil is constituted by piling a plurality of superconducting coil units. When patterning a superconducting oxide film formed on a substrate into a vortex, a special technique is demanded, but it is not difficult. The thickness of the superconducting oxide film and the thickness of the substrate are 0.1 mm. When the width of the patterned superconducting film is 0.1 mm, the current density of the case that an electric current of 1A flows in the coil, that is, the patterned superconducting oxide film, is 10000A/cm$^2$. The value of the above current density is the value of critical current density or less in the condition that superconducting oxide of Y—Ba—Cu—O is cooled to the liquid nitrogen temperature, for example. 500 of the superconducting coil units are connected to each other. An inside terminal and an outside terminal of each superconducting coil units are connected to adjacent superconducting coils. Therefore, there are 1000 connection parts in a coil having the 500 superconducting coil units.

In this coil, conductor parts exist as the connection parts between the superconducting coil units. But the resistance of the whole coil consists of only the contact resistance between the conductors and superconductors at the connection parts and the resistance of the conductors themselves. And if the cross sections of the connection parts are sufficiently large, the resistances of the conductors can be ignored and it may be enough to take only the contact resistance into account.

Practically, in the case that the conductor has width of 10 cm, thickness of 50 μm, and length of 500 μm, the resistance of the conductor is only about $10^{-6}\Omega$. The contact resistivity (contact resistance x contact area) of the superconductor and the conductor such as silver can be $1\times10^{-11}\Omega.cm^2$ or less, namely, low resistivity. Even though the contact resistance is $1\times10^{-4}\Omega$, which is rather large, the resistance of the whole coil is only $0.1\Omega$. This resistance value is 1/10000 as much as resistance of a coil whole of which is composed of conducting lead wires, and the demand of the coil of this embodiment becomes very little. A concrete method of forming connection parts is described in the embodiment shown hereinafter.

Next is described a formation of a superconducting oxide coil unit. This superconducting oxide coil unit is formed by patterning a superconducting oxide thick film (having a film thickness of 10 μm or more, preferably 100 μm or more) with high critical current density formed on a proper substrate.

A high critical current density is obtained from a superconducting oxide coil formed by forming a superconducting oxide film on a substrate by a melting method or the like followed by patterning the superconducting film. This is because a superconducting film formed by the melting method has a high critical current density.

For reference, a high critical current density is not obtained from a superconducting oxide coil formed by other methods, for example formed by forming a superconducting line covered with a silver sheath by silver sheath method followed by coiling the superconducting line. This is because a superconducting oxide coil formed by such methods does not have a high critical current density.

When forming into coil, it is necessary to pattern the superconducting oxide film by means of any methods. In principle any patterning methods can be used. However, it is preferred that the method satisfies following four conditions: the method does not cause mechanical distortion and cracks in the film; the method does not give influences to the property of remaining portions which are not removed; the method is a high speed processing; and the method is a fine processing, which preferably has processing precision of 100 μm or less). Considering these points, laser processing may be the most suitable for patterning a superconducting oxide film into a coil. Compared with processing by the use of focused electron beam for instance, this laser processing is inferior at the viewpoint of fine processing but is far superior at the viewpoint of productivity. Concerning a method of forming a superconducting thick film, not only melting method but also any other methods by which can be obtained a superconducting film having high critical current density can be employed. But the employed method should be superior in productivity. Therefore, forming a thick film by means of an usual method of forming a thin film, although a film having high critical current density may be formed by the method, is not suitable for forming the film used for the superconducting coil of the present invention. However, a film formation method having sufficiently large deposition rate may be employed. For example, in a laser ablasion film formation method, which is well-known as a method of thin film formation, the deposition rate can be made very large (100 nm/s), so that this method is also suitable for a thick film formation method.

By means of the method described above, a superconducting coil which operates at liquid nitrogen temperature can be formed using superconducting oxide. A superconducting electromagnet constituted by using this coil can generate a sufficiently larger magnetic field, compared with conventional superconducting electromagnets.

Embodiment No. 1

First of all is described a method of forming a superconducting film of Y-Ba-Cu-O.

Melting method described hereinafter is used to form a superconducting film. Superconducting powder is solved in a solvent, then the solution is applied on a substrate. After the preceding substrate is dried, the superconductor is melted by high temperature treatment, and subsequently by cooling it gradually, superconducting crystals are grown up. And finally a superconducting material having high critical current density is obtained.

As raw materials is used high purity powder (the purity is 99.9% or more) of yttrium oxide ($Y_2O_3$), barium carbonate ($BaCO_3$), and copper oxide (CuO), and the powder is sufficiently mixed with a ratio represented by the stoichiometric formulae $YBa_2Cu_3O_y$. Subsequently the mixture is baked in the air at a temperature of 900 degrees Centigrade for 12 hours and then gradually cooled. This baked material is broken into pieces to make a superconducting material composed of fine particles having grain diameter of 10 μm or less. This superconducting powder of Y-Ba-Cu-O is mixed with octyl alcohol to make a mixture paste. The superconducting powder and the octyl alcohol is mixed with weight ratio of 2:1.

This paste is applied on a high purity alumina substrate (whose size is 10 cm×10 cm×0.2 cm having a through hole of 5 cm×5 cm size in the center thereof). The thickness of the paste dried after being applied on the substrate is about 0.3 mm. This paste is melted and recrystallized to make a high density superconducting film. Two different methods of baking are attempted.

In one of the baking methods, all the process of baking is carried out in the air. At first, the film is maintained at a temperature of 1100° C. for 30 minutes to be melted and then it is gradually cooled to room temperature. But considering crystal growth and phase transition, cooling rate is regulated at 100° C. per hour from 1100° C. to 1020° C., at 2° C. per hour from 1020° C. to 950° C. (in this temperature range crystals of superconducting phase are grown up), at 100° C. per hour from 950° C. to 650° C., and at 10° C. per hour from 650° C. to 300° C. (in this temperature range tetragonal—orthorhombic phase transition of crystal structure of superconductor happens). From 300° C. the film is rapidly cooled to room temperature.

In the other of the two baking methods, a part of baking is carried out in nitrogen atmosphere, and the rest is in the air. At first, the film is maintained in nitrogen atmosphere at 1000° C. for 30 minutes to be melted, and then it is gradually cooled to room temperature. But considering crystal growth, cooling rate is regulated at 2° C. per hour from 1000° C. to 800° C. (in this temperature range crystals of superconducting phase are grown up) and at 100° C. per hour from 800° C. to 300° C. From 300° C. the film is rapidly cooled to room temperature. Subsequently the film is annealed in the air to change the film to superconductor. The annealing is carried out in the air at a temperature of 500 degrees Centigrade for 24 hours and after the annealing the film is rapidly cooled to room temperature.

Any of the films of Y-Ba-Cu-O formed by the above method exhibit superconductivity at a temperature of about 90K. The films are about 0.1 mm thick and an average grain diameter of the superconductor is from 10 μm to 100 μm. These films are selectively etched with modulated laser pulses to form strip patterns of 0.1 mm width, and then the critical current density is measured. The critical current density is measured by the use of a DC current in the condition that a magnetic field is not applied externally in particular, as immersing the film in liquid nitrogen. The critical current density of 10000 A/cm$^2$ or more can be obtained from any of the films. Due to problems of the measurement system, it is impossible to apply an electric current more than this level. It is considered that practically the critical current density is far larger.

Next, a method of patterning a superconducting film is described.

Modulated laser pulses are concentrated by making use of at least one lens, and the superconducting thick film formed by the preceding method is selectively etched by scanning the laser pulses as radiating the film with it. The scanning is carried out by fixing the film on X-Y stage and moving this X-Y stage by means of a step motor controlled by a computer. Conditions of laser processing appear in Table 1.

TABLE 1

| Conditions of Laser Processing | |
|---|---|
| Laser | Q switch Nd:YAG (Wave Length 1064 nm) |
| Pulse Width | about 100 ns |
| Repeating Frequency | 2 kHz |
| Average Output | 1 W |
| Beam Diameter | about 50 μm |
| Scanning Rate | 5 mm/s |

A cross section of a groove formed by laser radiation has a U form and the width of the groove is 50 μm. The depth of the groove formed by one scanning is about 80 μm, but by repeating the laser scanning twice, the superconductor can be completely severed.

Superconductivity of the area around the radiated part of the film may be destroyed by the heat. When forming superconducting strip patterns having various widths under the conditions of Table 1 and researching the superconducting properties, the result which appears in Table 2 is obtained. This result concerns the films formed by means of the method of thermal treatment only in the air, however, almost the same result can be obtained concerning the films formed by means of the other method of thermal treatment both in nitrogen and in the air.

TABLE 2

Relation Between Width of Superconducting Strips Formed by Laser Processing and Superconducting Property

| Width (μm) | Tc (K) | Jc (77K) (A/cm$^2$) |
|---|---|---|
| 20 | — | — |
| 40 | 35 | — |
| 50 | 75 | — |
| 70 | 84 | $2 \times 10^3$ |
| 100 | 90 | $>1 \times 10^4$ |
| 150 | 92 | $>1 \times 10^4$ |
| 200 | 92 | $>1 \times 10^4$ |

Tc: temperature at which resistance falls to zero
Jc: critical current density in the condition that a magnetic field is not applied externally As apparent in Table 2, in the case of the strips having width of 70 μm or less, the area where superconductivity is destroyed is wide, so that sufficient superconductivity can not be obtained and Tc becomes low. However, in the case of the strips having width of 100 μm or more, although an area where superconductivity is destroyed is formed in the strips, an area which does not receive any damages is also formed in the strips, so that a critical current density sufficient for a practical use is obtained. In this embodiment, width of superconducting wire is 150 μm.

In FIG. 1 is shown a conceptual view of a concrete pattern of a superconducting coil. In the figure a coil which has only eight loops is illustrated to make the figure simple, but actually a coil of this embodiment has 250 loops. In addition a coil having a right-handed rotation from the inner to the outer and a coil having a left-handed rotation from the inner to the outer were formed in this embodiment. Right-handed rotation patterns and left-handed rotation patterns are easily formed by just changing the movement of the X-Y table when laser processing. In FIG. 1, 3 designates a part where the coil in FIG. 1 and an adjacent superconducting coil are electrically connected and 3' designates a part where the coil in FIG. 1 and another adjacent superconducting coil are electrically connected. The concrete connection method of these parts is described later.

Then a method of fabricating a superconducting electromagnet is described hereinafter.

Figure 2:
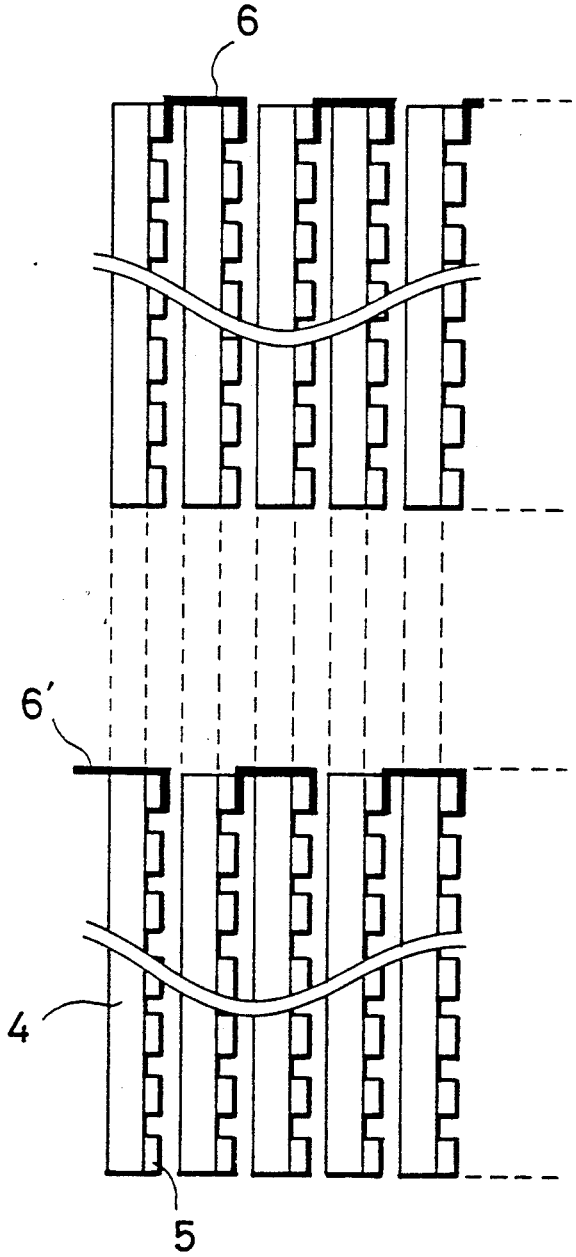
FIG. 2 is a view for showing connections between adjacent superconducting coils.

A superconducting coil is constituted by piling a lot of superconducting coil units. There is a problem of how to connect numbers of these superconducting coil units. In this embodiment these superconducting coil units are connected by the use of silver leaf. As shown in FIG. 2, silver leaves 6 and 6' having a thickness of 50 μm are pressed to adhere to an outmost rotation terminal 3' and an inmost rotation terminal 3 of superconductor 5 of each superconducting coil unit, so that superconducting coil units are connected in series by means of the silver leaves.

At this moment, by piling units of right-handed rotation and units of left-handed rotation alternatively, the outmost rotation terminals are connected to each other and the inmost rotation terminals are connected to each other. And the connections of the outmost and the inmost are carried out alternatively in order that electric current flows toward one direction in the coil. Namely, the terminal 3' of outmost rotation of the right-handed rotation unit and the terminal 3' of outmost rotation of the left-handed rotation unit are connected by the use of the silver leaf 6, then the terminal 3 of the inmost rotation of this left-handed rotation unit and the terminal 3 of inmost rotation the adjacent right-handed rotation unit are connected by the use of the silver leaf 6', and thereby electric current flows toward one direction in a coil constituted in this way.

The superconducting coil constituted by piling a lot of superconducting coil units as described above is baked in the air at a temperature of 940° C. for 20 hours. By baking it, the electrical connection between the superconducting coil unit and the silver leaf is strengthened. At the connection part formed by means of the above method, the contact resistivity is estimated about $10^{-8}$ Ω.cm$^2$. After baking it at a temperature of 940° C., it is gradually cooled at a rate of 100° C. per hour from 940° to 650° C. and at a rate of 10° C. per hour from 650° to 300° C., and subsequently it is taken out to the air having room temperature.

Figure 3:
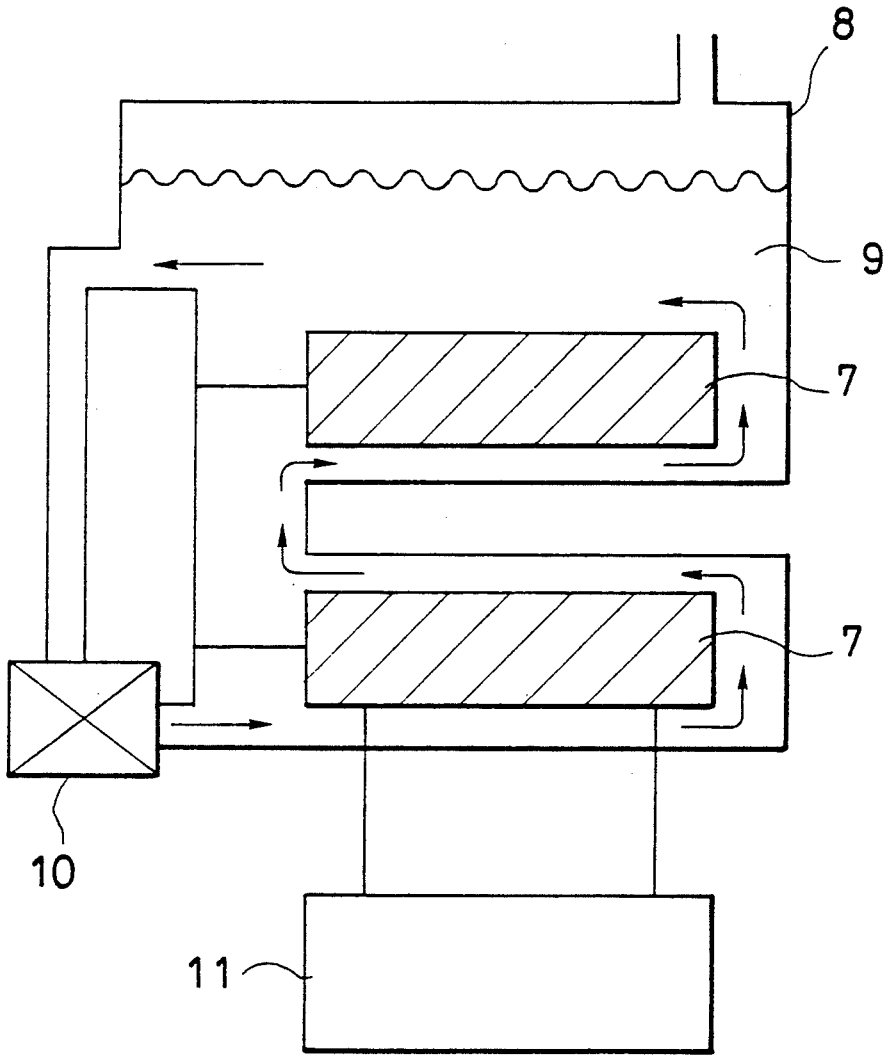
FIG. 3 is an outline showing an electromagnet by the use of superconducting coils according to the present invention.

Next is described a whole configuration of a superconducting electromagnet. A coil 7 which is formed by means of the preceding method (namely, which comprises 500 of superconducting coil units) is placed in a heat insulating vessel 8 as shown in FIG. 3. Liquid nitrogen is constantly circulating in the vessel in order to cool the superconducting coil. In particular, flow of liquid nitrogen is directly connected with connection parts between superconducting coil units generating a large amount of heat in order to cool the superconducting coil effectively.

It is confirmed by Hall element that when electric current of 2A is applied to the coil 7, a magnetic field of 1.5 tesla is generated at the center of the coil 7.

The superconducting coil according to this embodiment has a structure as shown in FIG. 2. Namely, adjacent substrates do not make contacts with each other, and further coils do not make contacts with adjacent substrates. Adjacent coils only make contacts with each other through the silver leaves 6 and 6'. Therefore, during the cooling shortly after baking the superconducting coil at a temperature of 940 degrees Centigrade for 20 hours, there happen no cracks in the coil due to the difference between coefficients of thermal expansion. On the contrary, if a matter, e.g. an insulating matter, is provided between the substrates, cracks are generated in the coil during the cooling due to the difference between the coefficient of thermal expansion of this matter and that of the coil material.

Embodiment No. 2

Figure 4:
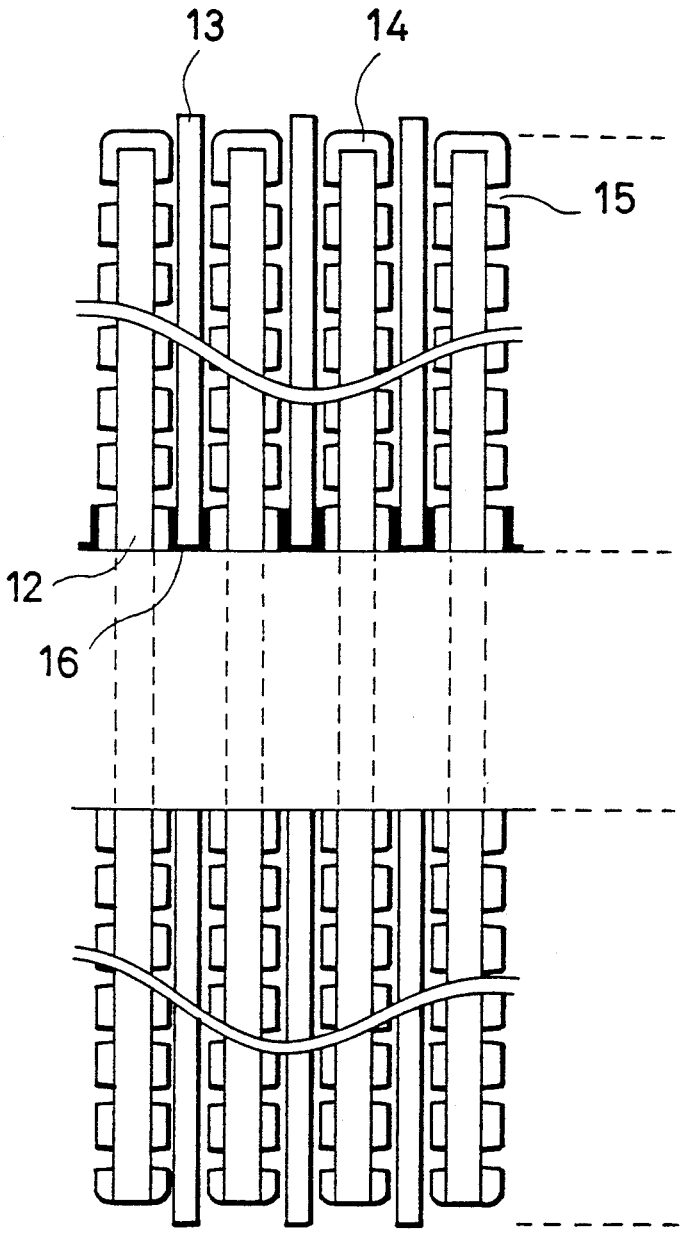
FIG. 4 is another view for showing connections between adjacent superconducting coils.

Here is also described an embodiment of a method of producing a superconducting electromagnet using superconductor of Y-Ba-Cu-O (whose Tc is 92K) in the same way as Embodiment No. 1. However, unlike the case of Embodiment No. 1, in this case superconducting films are formed on both surfaces of a substrate. At first, a film formation method is described. The paste used in Embodiment No. 1 is applied on both surfaces of a high purity alumina substrate (whose size is 10 cm×10 cm×0.2 mm and which has a through hole of 5 cm×5 cm size in the center). The superconducting paste is also applied on an edge surface of the outside of the substrate. The film thickness after drying is about 0.3 mm. Baking of this film is carried out in the air. First of all, the film is maintained at a temperature of 1100° C. for 30 minutes to be melted and subsequently is gradually cooled to room temperature. However, considering crystal growth and phase transition, the cooling rate is regulated at 100° C. per hour from 1100° to 1020° C., at 2° C. per hour from 1020° to 950° C. (in this temperature range the crystals of superconducting phase are grown up), at 100° C. per hour from 950° to 650° C., and at 10° C. per hour from 650° to 300° C. (in this temperature range tetragonal—orthorhombic phase transition of crystal structure of superconductor happens). From 300° C. the film is rapidly cooled to a room temperature. In the film completed according to the preceding process, the critical temperature is about 90K and the critical current density is 10000 A/cm$^2$ or more about the conditions of a temperature of 77K and magnetic field of zero. Both of the films on the substrate surfaces are patterned by means of laser pulses under the conditions of Table 1 to form superconducting coil units. At this moment, the vertical directions of the coils on one surface and the other surface of the substrate is made opposite in order that electric current flows toward the same direction. As shown in FIG. 4, the superconducting coil units are piled sandwiching an insulating matter such as alumina board 13 in this embodiment and are connected by the use of silver leaf 16 having a thickness of 50 μm. Then they are baked in the air at a temperature of 940 degrees Centigrade for 20 hours and thereby connection part having low contact resistance is formed.

A superconducting electromagnet is constituted which comprises 500 of such superconducting coil units. Hereupon it is observed that a magnetic field of about 1 tesla is generated in the center of the coil when electric current of 2A flows in the coil.

Embodiment No. 3

In this embodiment superconductor is formed on both surfaces of one substrate in the same way as Embodiment No. 2. The forming method or the like is the same as that in Embodiment No. 2.

Figure 5:
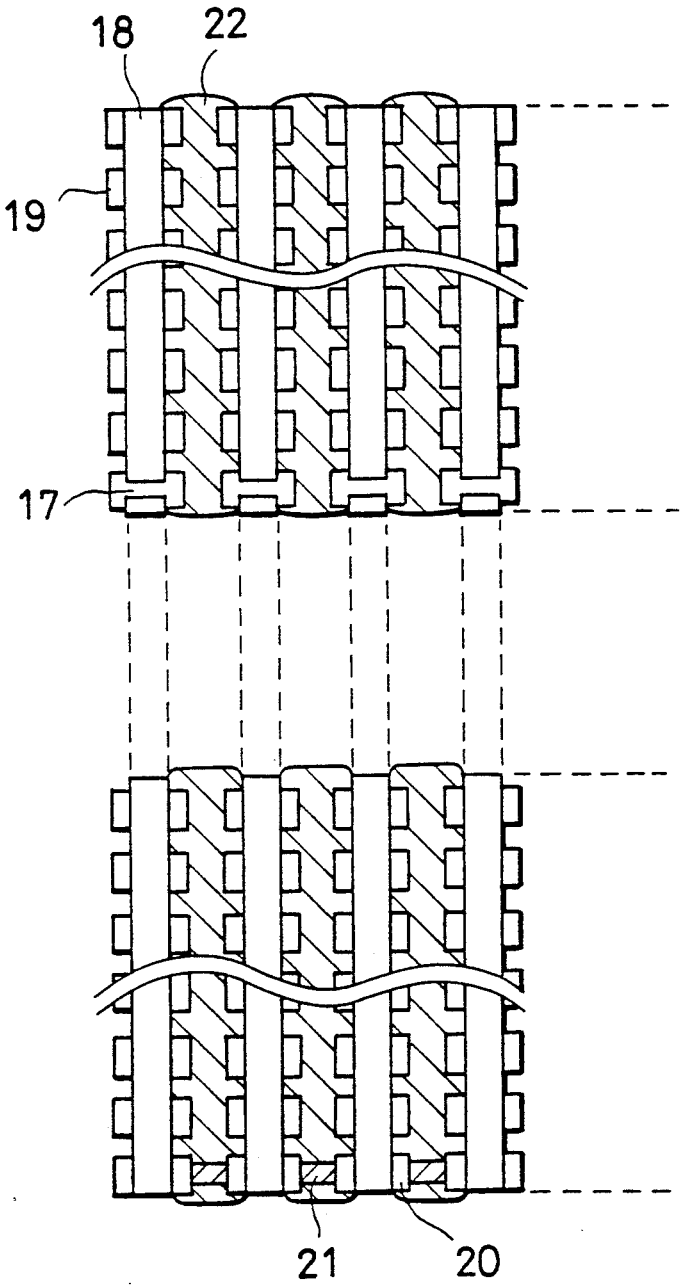
FIG. 5 is further another view for showing connections between adjacent superconducting coils.

In FIG. 5 is shown a cross sectional view of a superconducting coil. As apparent from the figure, in a substrate 18 is provided a through hole 17, and by means of this through hole 17 superconductors 19 on the both surfaces of the substrate are electrically connected. As another case, a metal may be previously stuffed in this through hole in order that electric current flows between the both surfaces.

These superconductors are patterned by means of laser processing in the same way as Embodiment No. 2 and a right-handed rotation vortex is formed on one surface and a left-handed rotation vortex on the other surface. A good conductor 21 is provided at a terminal 20 of the outmost rotation of a unit, and such units adhere to each other with organic insulator, e.g. polyimide resin 22 to form a coil.

In this embodiment the polyimide resin with which the units adhere to each other can be provided on the whole surface of the coil. In this case, since the superconductor does not make a contact with the air and cooling medium directly, the reliability of the superconductor can be improved.

According to the present invention, a strong magnetic field can be easily generated which was not generated stably unless liquid helium was used in the prior art. In the embodiments of the present invention, the generated magnetic field is just 1 to 2 tesla. This is because the superconducting electromagnet produced in these embodiments is small. Therefore, it is not impossible to generate a stronger magnetic field according to the present invention. Practically, when a scale of the superconducting electromagnet is 10 times as large as the scale of the superconducting electromagnet described in the embodiments, or the quantity of electric current is made 10 times as much, a magnetic field of 10 to 20 tesla can be generated, namely, a magnetic field can be generated which is as large as that generated from a large-sized superconducting electromagnet of conventional type. It is sufficiently possible even in accordance with present art that the scale of a superconducting electromagnet and the quantity of electric current flowing are made 10 times as large and as much. Such a super strong magnetic field can be utilized for a nuclear fusion reactor of magnetic field confining type and a corpuscular rays accelerator, and with respect to a comparatively small magnetic field of a few tesla, industrial applications for a measuring apparatus such as MRI or the like and a linear motor car of magnetic levitation type are widely expected. Advantages of the present invention are as follows.

1. A large magnetic field can be obtained by means of a simple apparatus.

2. Instead of liquid helium which is expensive and difficult to deal with, liquid nitrogen can be used which is cheap.

3. Economically the running cost is far low, compared with a conventional superconducting electromagnet and a conventional conducting magnet (the price of liquid nitrogen is about 1/20 of that of liquid helium).

As shown hereinbefore, the profit which the present invention gives to the industrial world is enormous.

Also in the present invention it is possible to process easily both units having a right-hand rotation and a left-handed rotation, so that the outmost rotations of units are connected to each other and the inmost rotations of units are connected to each other. Thus the connection structure of a coil is simplified, and a coil is easily produced by piling a plurality of units.

It is well-known that in superconducting oxide a superconducting electric current flows two dimensionally. In the present invention one superconducting coil is formed on one surface of a substrate, and thereby such superconducting coils have good crystallization, so that in the superconducting coils this two-dimensional superconducting electric current flows well. The superconducting coils of the present invention have superior superconducting properties, as mentioned above.

Figure 6:
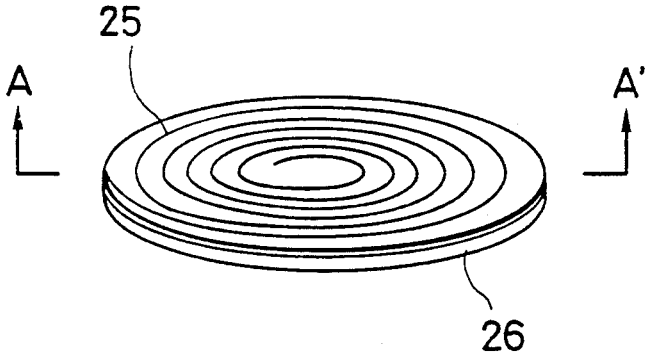
FIG. 6 (A) PRIOR ART
FIG. 6 is a view showing a conventional superconducting coil.
Figure 6:
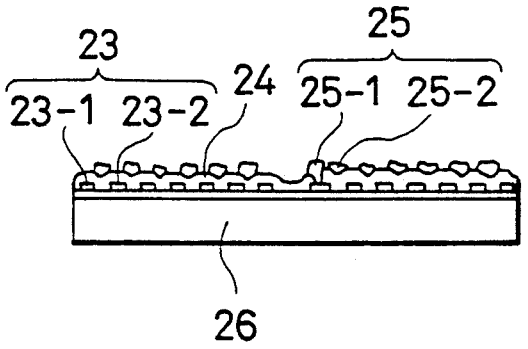
FIG. 6 (B) PRIOR ART

For reference in FIG. 6(A) and (B) showing a conventional superconducting coil, superconducting coils 23, 25 and a layer 24, e.g. a layer made of an insulating material, are piled one by one. In such superconducting coils, as the superconducting coils and the layers are further piled one by one on the coil 25 of FIG. 6(B) (FIG. 6(B) shows a cross sectional view at A—A' line of FIG. 6(A)), micro steps are formed on the surfaces of the superconducting coils and the layers. The steps become larger on upper layers. Because of this, crystallization in the coils is degraded and it is not probable that such a two-dimensional superconducting electric current as mentioned above flows in the coil.

In the above embodiments is described a superconducting coil made of $YBa_2Cu_3O_y$, however, other superconducting materials may be used to form coils on substrates as long as coils have large mechanical strength. For example, superconducting coils of the present invention may be formed by making use of $(La_{1-x}M_x)_2CuO_4$ (M=Ba, Sr, Ca, K), $La_2CuO_4$, $(Ln_{1-x}M)_2CuO_4$ (Ln=Nd, Pr, Sm, M=Ce, Th), $(Nd_{1-x-y}Sr_xCe_y)_2CuO_4$, or $(Ln_{1-x}M_x)_2(Ln_{1-y}M'_y)_2Cu_3O_z$ (Ln=Nd, Sm, Eu, M=Ce, M'=Ba) wherein $0 \leqq x \leqq 1$, $0 \leqq y \leqq 1$. In this case critical temperatures are lower than the liquid nitrogen temperature. Superconducting coils of the present invention may be also formed by the use of $LnBa_2Cu_3O_z$ (Ln=rare earth elements), $LnBa_2Cu_4O_8$ (Ln=Y and rare earth elements), $Ln_2Ba_4Cu_7O_{15}$ (Ln=Y and rare earth elements), $Bi_2Sr_2Ca_{n-1}Cu_nO_{2n+4}$ (n=1 to 5), $Tl_2Ba_2Ca_{n-1}Cu_nO_{2n+4}$ (n=1 to 4), $TlBa_2Ca_{n-1}Cu_nO_{2n+3}$ (n=1 to 5), $TlSr_2Ca_{n-1}Cu_nO_{2n+3}$ (n=2, 3), $Pb_2Sr_2Ln_{1-x-y}Ca_xSr_yCu_3O_8$ (Ln=Y and rare earth elements), $Tl_{1-x}Pb_xSr_2Ln_{1-y}Ca_yCu_2O_z$ wherein $0 \leqq x \leqq 1$, $0 \leqq y \leqq 1$ and rare earth elements are La, Ce, Pr, Nd, Pm, Sm, Eu, Gd, Tb, Dy, Ho, Er, Tm, Yb, Lu, Sc, and Y.

Since other modification and changes (varied to fit particular operating requirements and environments) will be apparent to those skilled in the art, the invention is not considered limited to the examples chosen for purposes of disclosure, and covers all changes and modifications which do not constitute departures from the true spirit and scope of this invention.

What is claimed is:

1. A superconducting coil comprising:

a plurality of coils which are formed on respective surfaces of substrates, said coils made of an oxide superconducting material, wherein adjacent coils are electrically connected to each other by metal in order to form one coil from all of said plurality of coils and wherein each of said coils has a critical current density of at least 10,000 A/cm$^2$ at 77K in the absence of any externally applied magnetic field.

2. The superconducting coils of claim 1 wherein insulating materials are provided between said substrates.

3. The superconducting coil of claim 1 wherein said coils are arranged concentrically.

4. The superconducting coil of claim 1 characterized in that each of said coils can generate a magnetic field substantially in one sense by energizing said coils.

5. The superconducting coil of claim 1 wherein said coils are formed on the same side surfaces of all of said substrates.

6. A superconducting coil comprising:

a plurality of coils which are formed on opposite surfaces of substrates, said coils made of an oxide superconducting material, wherein adjacent coils are electrically connected to each other by metal in order to form one coil from all of said plurality of coils.

7. A superconducting coil comprising:

a plurality of coils which are formed on opposite surfaces of substrates, said coils made of an oxide superconducting material, wherein each of said substrates has a through hole and adjacent coils are connected to each other by a connector provided in said through hole, said connector being metal.

8. The superconducting coil of claim 1 wherein said metal is silver.

9. The superconducting coil of claim 6 wherein said metal is silver.

10. The superconducting coil of claim 6 wherein insulating materials are provided between said substrates.

11. The superconducting coil of claim 6 wherein said coils are arranged concentrically.

12. The superconducting coil of claim 6 characterized in that each of said coils can generate a magnetic field substantially in one sense by energizing said coils.

13. The superconducting coil of claim 7 wherein said metal is silver.

14. The superconducting coil of claim 7 wherein insulating materials are provided between said substrates.

15. The superconducting coil of claim 7 wherein said coils are arranged concentrically.

16. The superconducting coil of claim 7 characterized in that each of said coils can generate a magnetic field substantially in one sense by energizing said coils.

* * * * *